US006634762B2

(12) United States Patent
Cilia

(10) Patent No.: US 6,634,762 B2
(45) Date of Patent: Oct. 21, 2003

(54) COMBINED SYSTEM FOR ILLUMINATION AND WATERING

(76) Inventor: Juan Ignacio Cilia, Calle 27 N$^{a}$1570 La Plata, Codigo Postal (1900), Provincia de Buenos Aires (AR)

( * ) Notice: Subject to any disclaimer, the term of this patent is extended or adjusted under 35 U.S.C. 154(b) by 0 days.

(21) Appl. No.: 10/092,027

(22) Filed: Mar. 6, 2002

(65) Prior Publication Data

US 2002/0131265 A1 Sep. 19, 2002

(30) Foreign Application Priority Data

Mar. 7, 2001 (AR) ..... P 01 01 01077

(51) Int. Cl.$^{7}$ ..... F21V 33/00

(52) U.S. Cl. ..... 362/101; 362/96; 362/252; 362/562

(58) Field of Search ..... 362/96, 101, 562, 362/154, 231, 276, 252

(56) References Cited

U.S. PATENT DOCUMENTS 4,305,117 A * 12/1981 Evans ..... 362/96
5,934,796 A * 8/1999 Quereau ..... 362/318

* cited by examiner

*Primary Examiner*—Sandra O'Shea
*Assistant Examiner*—John Anthony Ward
(74) *Attorney, Agent, or Firm*—Martin Fleit; Paul D. Bianco; Fleit Kahn, Gibbons Gutman Bongini & Bianco, P.L.

(57) ABSTRACT

A combined integrated apparatus for providing illumination and water that consists of a structural support that contains one pipe for transferring water and one pipe for conducting electricity. A light emitting device and a water-emitting nozzle are coupled to the structural support, and the apparatus is powered using electric and hydraulic energy.

22 Claims, 6 Drawing Sheets

COMBINED SYSTEM FOR ILLUMINATION AND WATERING

BACKGROUND OF THE INVENTION

1. Field of the Invention

The present invention relates to a combined system or apparatus for providing illumination and water.

2. Prior Art

The features of this invention arise out of daily observations of different problems that arise when the two systems (lighting systems and watering systems) are applied independently of one another. That is, when a lighting system is installed with the intention of illuminating a defined area, and it is later desired to install a watering system in the same area, or vice versa. Upon installation of the watering system in this scenario, the desired area must be dug up to install additional pipes—water pipes. Often the electrical pipes that were laid (typically subterranean) during installation of the lighting system are encountered during digging, posing an obstacle to the installation of the watering system.

Further, the laying of additional water pipes decreases the amount of land available for planting trees, plants, flowers, etc. This problem is further compounded when, in those parks and gardens possessing a variety of plants and bushes of different heights and which are relatively close together, it is necessary to increase the amount of water piping in order to increase the number of water-emitting nozzles provided. In addition, plants and bushes may pose an obstacle to watering in areas where the heights of plants and bushes are relatively high and the water-emitting nozzles may not clear the height of the plants and bushes.

SUMMARY OF THE INVENTION

The apparatus of the present invention comprises a combined system that includes a lighting system integrated with a watering system utilizing electric and hydraulic energy. The principal aim of the invention is generally directed towards public or private open areas such as parks, gardens, stadiums, plazas, greenhouses, buildings, homes, etc. The object of the invention is to unify and integrate two existing systems applicable to open areas, lighting systems and watering systems, in a novel and unique way, such that the utilization of these two systems is unified into one system.

Because in many cases a light is located near a water nozzle, one object of the invention is to integrate these two elements to avoid redundancy. This solution also creates the benefit of decreasing maintenance of the water nozzles (sprinklers, diffusers, fire sprinklers, etc.) because these fittings and fixtures can be adjusted at different heights to avoid obstacles, can be protected more easily, such as by a casing, and can be located such to avoid destruction and deterioration.

Another benefit is that the water nozzles, which are located and integrated with a light, can also serve to clean paths, rest areas, sidewalks, etc. using plain water or by adding a cleaning or disinfecting agent to the water being fed to the nozzles. In this case, the cleaning or disinfecting agent emitted would originate at a common cistern and be mixed at the apparatus of the invention or at the system providing electric or hydraulic energy to the apparatus of the invention.

Yet other benefits are the ability to regulate the temperature of the open areas, the ability to water dirt roads to quiet the surface, and the ability to combat fires in open or closed areas.

Yet another benefit includes the ability to control insects by using the apparatus of the invention as a fumigation device. In this case, the insecticide or insect repellant agent emitted would originate at a common cistern and be mixed at the apparatus of the invention or at the system providing electric or hydraulic energy to the apparatus of the invention with the purpose of decreasing the size of the infested area.

The apparatus of the present invention can be used in the agricultural industry, such as, by locating within homes, complexes or greenhouses to maintain and foster fruits, vegetables, flowers, etc. Alternatively, the apparatus of the present invention can be used in corrals or animal stables for illumination, cleaning or disinfecting. The apparatus of the present invention can also be used for aesthetic or public purposes.

Due to multiple uses of the apparatus of the present invention, as described above, additional components, such as manual or automatic controls, can be added to or integrated into the apparatus. These additional components can be barometers, photocells, microprocessors, motion sensors, etc. As an example, a system of the present invention can: A) automatically cease emitting water when the moisture level of the ground reaches a predetermined value due to a sensor that is coupled to a controller that controls the feeding of the water, B) more precisely control the reach or area being sprayed to coordinate an array of water nozzles with the water emitted by each to eliminate overlap and hence wasted water, C) emit different products via different water nozzles for the purposes noted above or others, D) provide fertilizer from remote parts of the system to the water nozzles, E) allow the automatic cessation of water emission at a given time either on a time basis or under the control of a controller and microprocessor responsive to a sensor, F) prevent the emission of water until a given time, etc.

The apparatus of the present invention can be structured and its elements combined in a variety of ways. For example, the main structure of the apparatus can be 1) a single, central structure, 2) expandable linearly as in a mesh form, 3) formed at the same time as the cable orifices, 4) formed of concrete for instances where the subterranean installation is impossible, such as areas having a large quantity of above-ground roots or agricultural areas, and 5) the water pipes and electric conduits can be installed above ground by suspending on suitable structural supports.

In an embodiment of the apparatus of the present invention, the apparatus can be used for fighting domestic, industrial or commercial fires by locating the apparatus near the ceiling and securing the apparatus to the ceiling, a column or the like. The apparatus shall be easily and simply mounted and dismounted in comparison with conventional installations of fire sprinklers or any other system to which the apparatus applies.

The following functions describe the apparatus of the present invention and any embodiment of the apparatus may manifest all or any combination of these functions:

1) the apparatus provides support and encases the water nozzle and the system utilizing electric and hydraulic energy
2) the apparatus may be formed of one piece
3) the interior and the exterior of the structure of the apparatus conduct electrical and hydraulic energy
4) the apparatus can be above or below ground
5) the apparatus can be attached to walls, roofs, etc.
6) the apparatus can be located indoors or outdoors
7) the apparatus integrates the lighting system and the watering system, wherein one system may be within another, or both systems housed within a common element or both systems housed within a third element 8) the apparatus is compatible with conventional lighting and watering systems 9) the apparatus operates effectively and precisely The elements of the present invention comprise a structural support which includes, contains or supports the following elements: a light, a watering system or water nozzle, whether a sprinkler or a diffuser, a system for conducting electricity and water, which can be constructed of pipes, tubular bodies or laminates and controls for the same, whether barometers, photocells, microprocessors, water nozzles, etc.

The following advantages over the prior art are described. First, upon installation, the present invention reduces the total length of the trenches that must be dug to install water and electrical pipes and the amount of manual labor consumed. Second, in order to overcome a watering obstacle in the terrain, the height of the water-emitting nozzle can be adjusted to the same height as the light-emitting device, which can be 4.00 meters or more. The most common height of a light-emitting device is 2.40 meters. Third, maintenance of sprinkler nozzles due to footsteps or collisions with external objects is decreased since the nozzle is located at an increased height. Fourth, the effectiveness of the watering process is guaranteed without depending on the height of the grass.

In the manner described, the present invention will satisfy the illumination, watering and fertilizing needs of public and private open and closed areas using a unified system provided in one installation.

The foregoing objects of the invention are achieved by providing an apparatus for providing illumination and water that comprises a structural support, at least one pipe for transferring water, at least one pipe for conducting electricity, a light emitting device and a water-emitting nozzle, wherein the apparatus is powered using electric and hydraulic energy. In the apparatus described, the structural support substantially encases the at least one pipe for conducting electricity and wherein the at least one pipe for conducting electricity is coupled to the exterior of the apparatus. Further, in the apparatus the structural support can substantially encase the at least one pipe for conducting electricity and wherein the at least one pipe for conducting electricity forms one piece with the apparatus.

In the apparatus, the at least one pipe for conducting electricity and the at least one pipe for conducting water-power the apparatus can use electric and hydraulic energy. The structural support can substantially encase the light-emitting device and the water-emitting nozzle. Further, the structural support can substantially encase the light-emitting device and the light-emitting device substantially encases the water-emitting nozzle. Also, the water-emitting nozzle can be any one of a spray nozzle, a fire sprinkler, a fumigation nozzle and a nozzle that emits plain water or plain water with another liquid.

The apparatus can be configured so that the height of the structural support is independent of the height of the water-emitting nozzle and the light-emitting device. Further, the light-emitting device can be located in any one of the lowest region of the structural support, the middle region of the structural support, the highest region of the structural support and within the structural support.

The apparatus can be configured so that the water-emitting nozzle is located in any one of the lowest region of the structural support, the middle region of the structural support, the highest region of the structural support and within the structural support.

The apparatus of the invention may further comprises a lock for regulating opening of the apparatus, more than one water-emitting nozzle, more than one light-emitting device, an automation device, a solenoid, a sensor, a mixer, a dose regulator, a sound-emitting device, a water heating element, a laser light-emitting device, a fiber optic light-emitting device, a control module utilizing satellite radio frequencies, a control module utilizing high frequencies, a barometer, a transmitter, a receiver, a cistern and/or a water storage device. Further, the water-emitting device can located above or below ground and the light-emitting device can be located above or at ground.

BRIEF DESCRIPTION OF THE DRAWINGS

Other objects and advantages of the invention will be apparent from the following detailed description when taken with the appended drawings briefly described below.

DETAILED DESCRIPTION OF PREFERRED EMBODIMENTS

Figure 1:
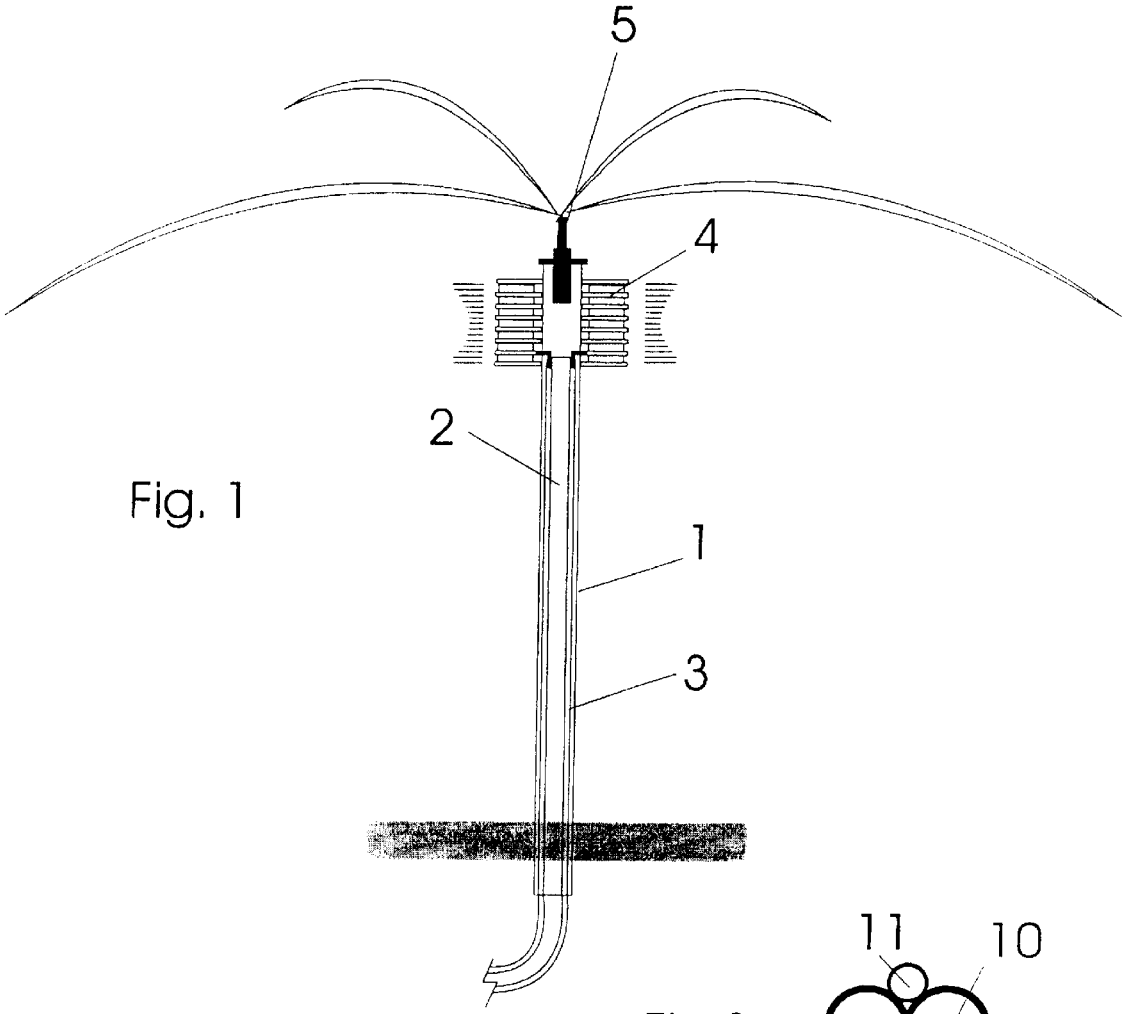
FIG. 1 shows schematically in cross section one embodiment of the present invention.
Figure 3:
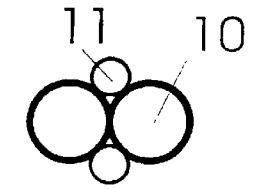
FIG. 3 shows schematically in cross section of FIG. 1 an alternative arrangement for the conduits for carrying the electric and water conduits or lines.
Figure 2:
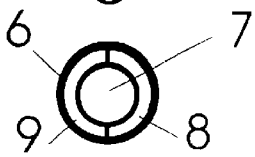
FIG. 2 shows schematically a transverse cross section of a structural support shown in FIG. 1.
Figure 4:
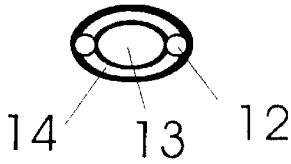
FIG. 4 shows schematically in cross section a yet further alternative arrangement.

The present invention will now be described with reference to the several figures of the drawings. FIG. 1 shows in cross-section of the present invention. FIG. 1 shows structural support 1, which encases a water pipe 2 and an electrical pipe 3. Also shown in FIG. 1 is a light-emitting device 4 and a water-emitting nozzle 5, which is emitting water. FIG. 2 shows a transverse cross-section of the structural support 6. Also shown in FIG. 2 is the water pipe 7 and compartments 8 and 9 utilized for housing the electric pipes. FIG. 3 shows a cross-section of the structural support. FIG. 3 shows two main pipes 10 and two minor pipes 11, wherein both pipes 10 and 11 can be used for water or electricity. FIG. 4 shows, an alternative arrangement that in addition to the oval section, two minor pipes 12, one central pipe 13 and the structural support 14.

Figure 5:
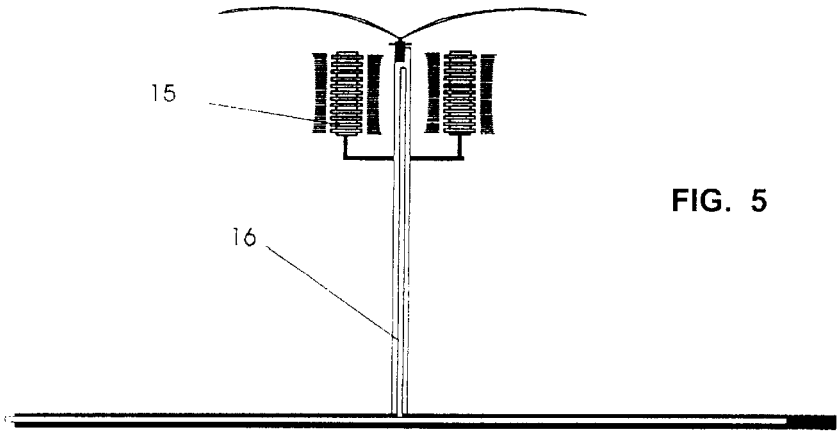
FIG. 5 shows schematically another embodiment.
Figure 6:
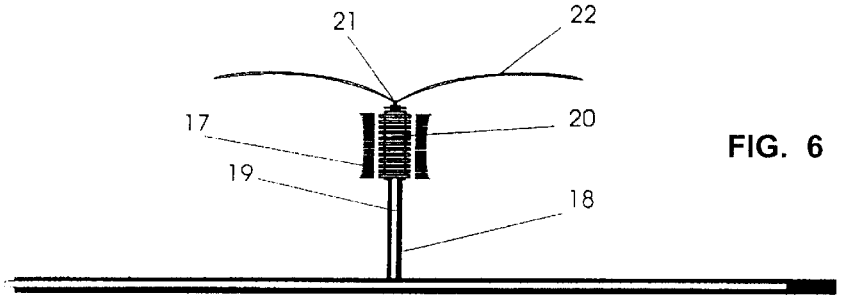
FIG. 6 shows schematically still another embodiment.
Figure 7:
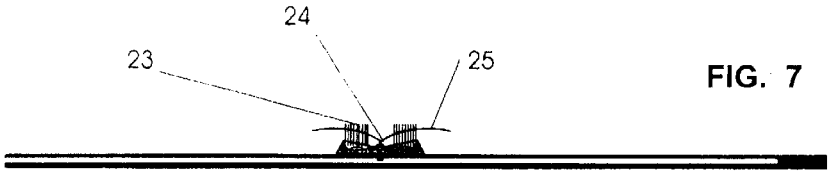
FIG. 7 shows schematically another embodiment.
Figure 8:
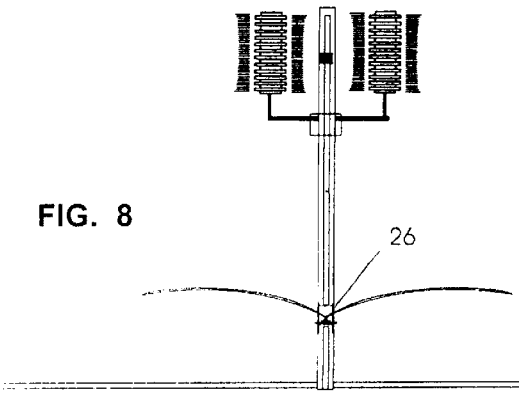
FIG. 8 shows schematically another embodiment showing an alternative placement of the water diffuser.
Figure 9:
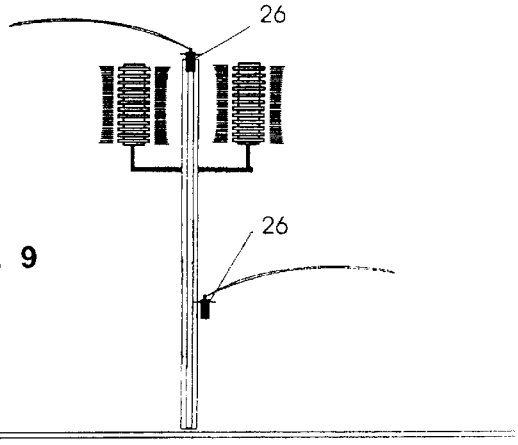
FIG. 9 shows schematically still another embodiment showing an alternative placement of the water diffuser.

In FIG. 5, which is a lateral view, there is shown an inverted light 15 coupled to multiple system 16, like what is shown in FIGS. 1–4, for providing electrical and hydraulic energy. FIG. 6 shows a non-inverted alternative light 17, multiple system 19 like what is sown in FIG. 1, a light 20 and inside the light 20 a water diffuser 21 coupled to watering system 22. FIG. 7 shows a non-orientable or fixed alternative light 23 which contains water diffuser 24 and which is coupled to watering system 25. FIG. 8 and FIG. 9 shows all the possible placements of water diffuser 26 in connection with the structure of the combined lighting and watering system.

Figure 10:
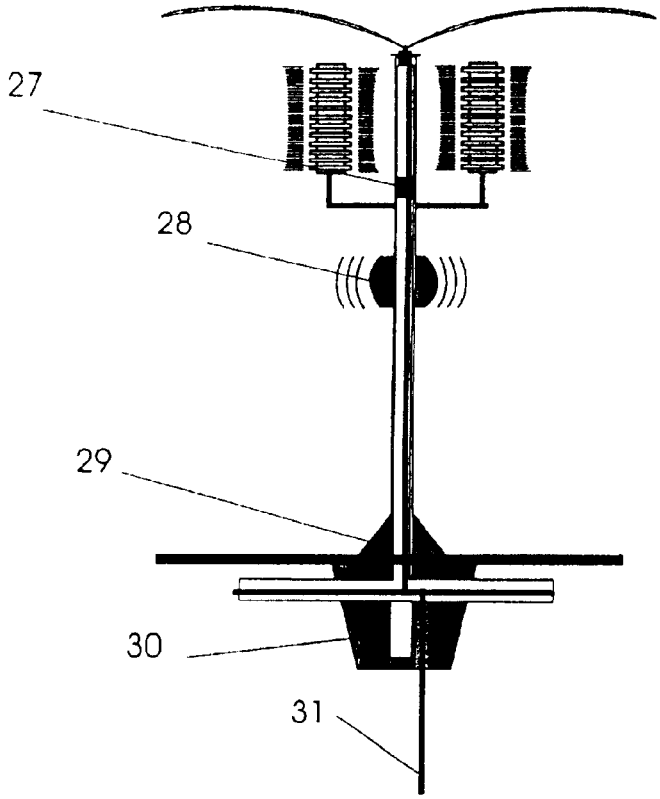
FIG. 10 shows schematically an embodiment using a motion sensor.
Figure 11:
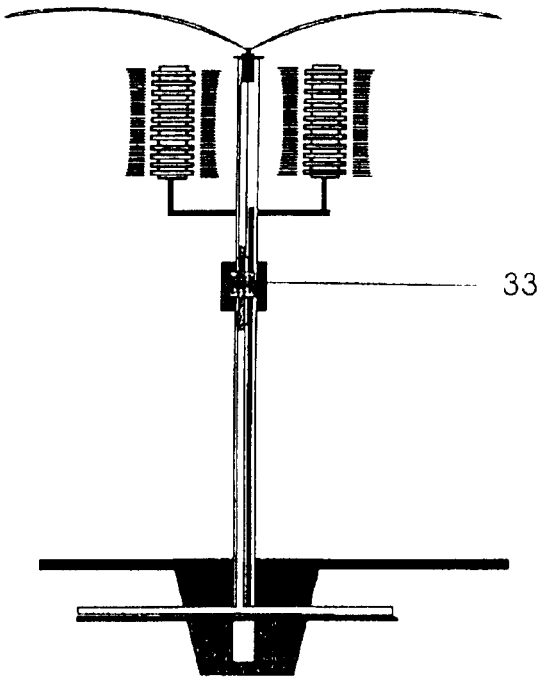
FIG. 11 shows schematically an embodiment an embodiment using a mixer to add material to the water.

FIG. 10 shows an alternative arrangement including a motion sensor 27 in conjunction with an alarm 28, coupled to a protector module 29 at the base of the apparatus. The base of the apparatus is placed at 30, with a spear inserted in the ground at 31. FIG. 11 shows a mixer 33 coupled to or into the water system, which can be used to incorporate a third liquid, powder or grain, for the purpose of using the apparatus as a fertilizer, insecticide distributor, sterilizer, cleaner, etc.

Figure 12:
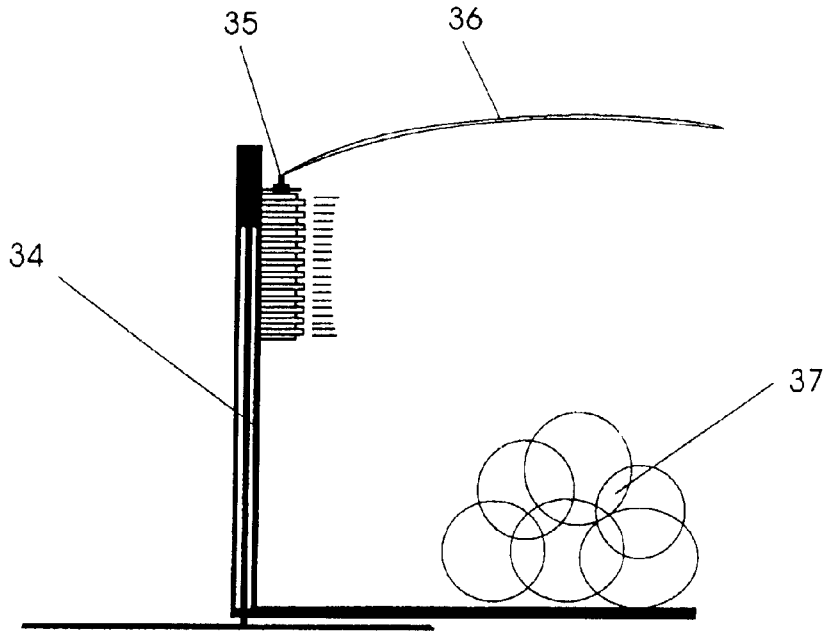
FIG. 12 shows schematically an embodiment illustrating a wall mounting.
Figure 13:
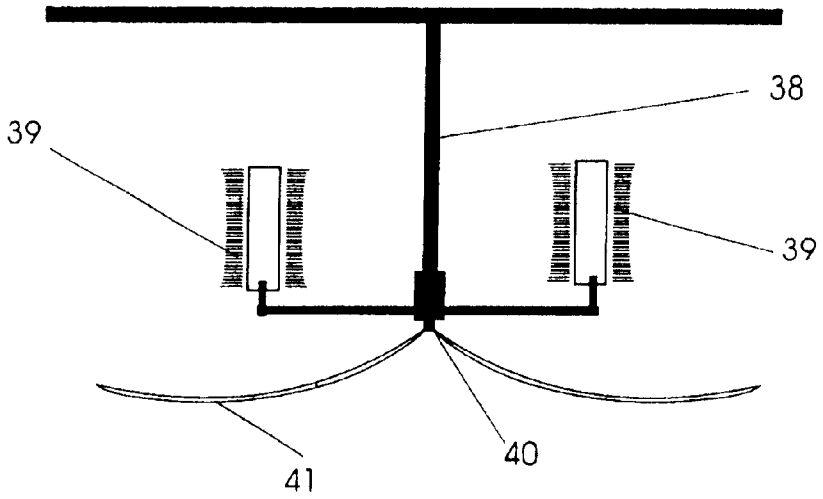
FIG. 13 shows schematically an embodiment that is roof mounted.

FIG. 12 shows one exemplary embodiment of the apparatus coupled to a wall 34, the water diffuser 35 coupled to the watering system 36, both of which are relatively located in front of a bush 37. FIG. 13 shows another embodiment of the system wherein the system is coupled to or hung from a roof, wherein the structural support 38 is above ground and connected to the roof structure at its upper end. Also shows in FIG. 13 are lights 39, the water diffuser 40 and the watering system 41.

Figure 14:
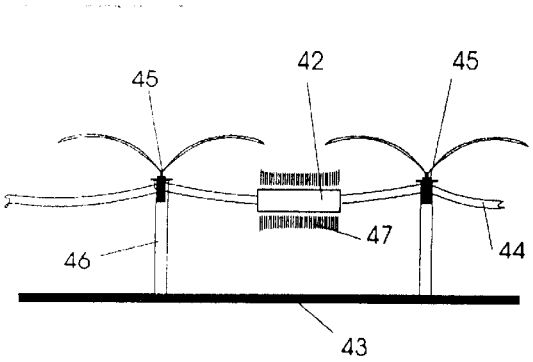
FIG. 14 shows schematically an embodiment for stringing lights above the ground.
Figure 15:
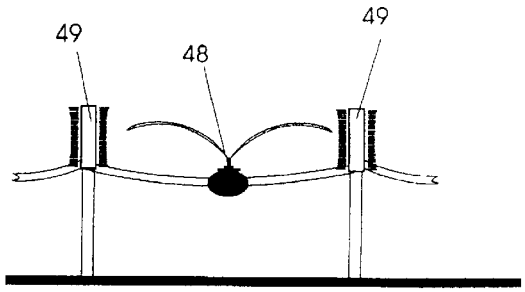
FIG. 15 shows schematically an embodiment for stringing diffusers above the ground.
Figure 16:
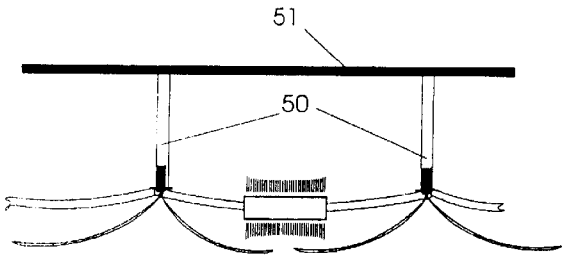
FIG. 16 shows schematically an embodiment for stringing lights from a roof mounting.
Figure 17:
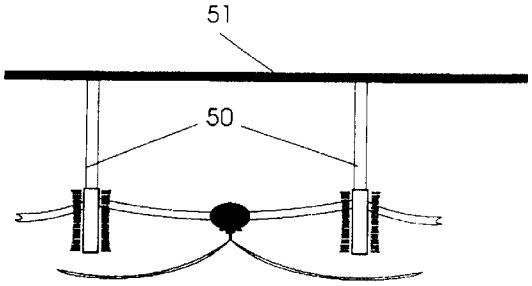
FIG. 17 shows schematically an embodiment for stringing diffusers from a roof mounting.
Figure 18:
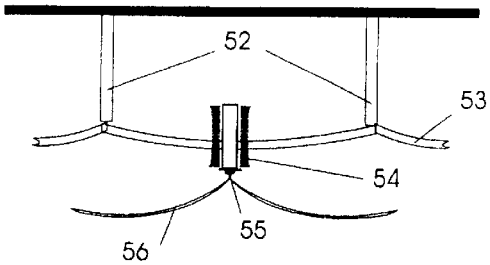
FIG. 18 shows schematically an embodiment for stringing combined lights and diffusers from a roof mounting.

FIG. 14 shows the way in which lights 42 are strung and supported above the ground 43. The lights are adjacent to a multiple suspension system for conducting electrical and hydraulic energy 44 to which is coupled diffusers 45, which are placed at the base of the apparatus or at support 46. Light 47 is shown on the multiple suspension system 44. FIG. 15 shows a similar embodiment as FIG. 14 except the placements of diffuser 48 and lights 49 are reversed or switched. Similar embodiments are shown in FIG. 16 and FIG. 17, respectively, except the supports 50 protrude or depend from the roof structure 51. A third alternative is shown in FIG. 18 wherein supports 52 are above multiple suspension system 53 for conducting electrical and hydraulic energy, which supports light 54 and light 54 encases diffuser 55, which is coupled to watering system 56.

Figure 19:
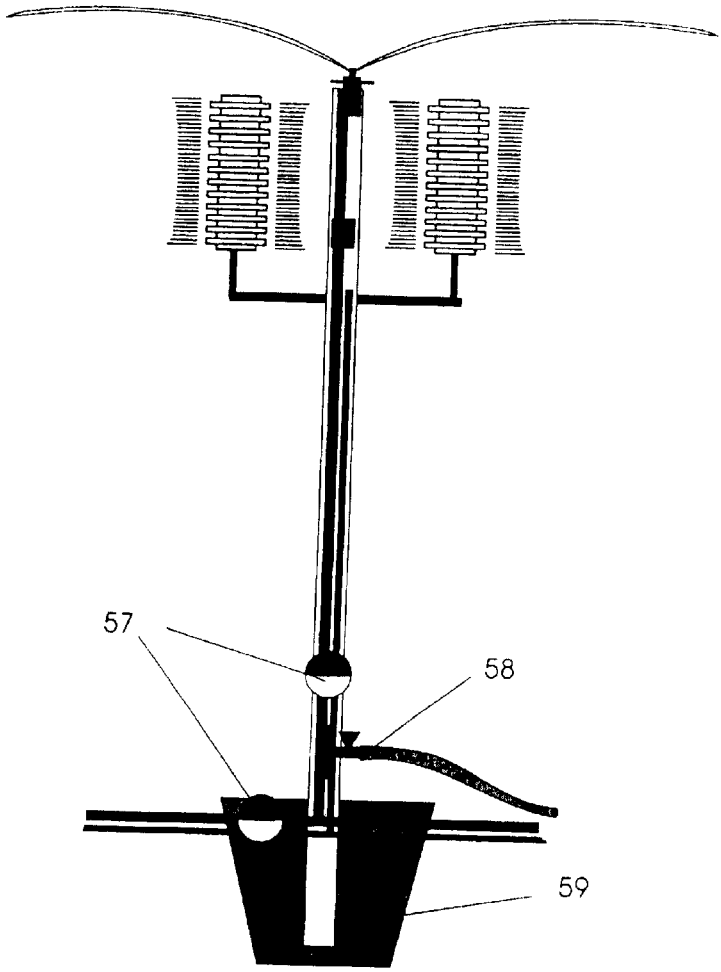
FIG. 19 shows schematically an embodiment that includes a cistern in its base.
Figure 20:
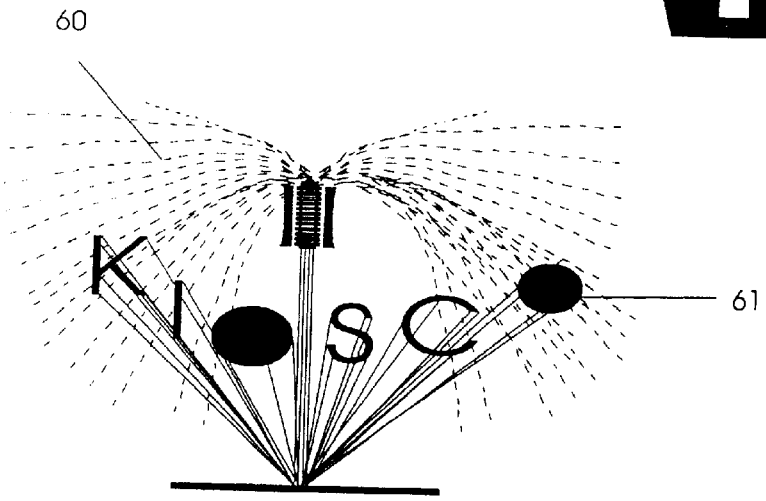
FIG. 20 shows schematically an embodiment including a laser projector associated with the diffuser or sprayer.

FIG. 19 shows an embodiment of the invention, which depicts the combined watering and lighting system adapted to utilize solenoid valves 57, modules 58, and cistern 59, which are mounted on the supporting structure and in the base of the apparatus. FIG. 20 shows how the watering system 60 can be used to project images 61, which can be projected by a laser projector located within the light of the apparatus, preferably at the base of the support structure.

Various changes will be apparent to those skilled in the art from the above description, which do not depart from the inventive concepts taught herein. Such are deemed to fall within the purview of the invention as claimed.

What is claimed is:

1. An apparatus for providing illumination and water, comprising:

a structural support;

at least one pipe for transferring water;

at least one pipe for conducting electricity;

a light emitting device; and a water-emitting nozzle, wherein the apparatus is powered using electric and hydraulic energy, and wherein the structural support substantially encases the at least one pipe for conducting electricity, and wherein the at least one pipe for conducting electricity forms one piece with the apparatus.

2. The apparatus of claim 1, wherein the at least one pipe for conducting electricity is located to the exterior of the apparatus.

3. The apparatus of claim 1, wherein the at least one pipes are mounted on the structural support.

4. The apparatus of claim 1, wherein the at least one pipe for conducting electricity and the at least one pipe for conducting water serve to conduct the electric and hydraulic energy to the apparatus.

5. The apparatus of claim 1, wherein the structural support substantially encases the light-emitting device and the water-emitting nozzle.

6. The apparatus of claim 5, wherein the structural support substantially encases the light-emitting device and the light-emitting device substantially encases the water-emitting nozzle.

7. The apparatus of claim 1, wherein the water-emitting nozzle is any one of:

a spray nozzle;

a fire sprinkler; and a fumigation nozzle.

8. The apparatus of claim 1, wherein the height of the structural support is independent of the height of the water-emitting nozzle and the light-emitting device.

9. The apparatus of claim 1, wherein the light-emitting device is located in any one of:

the lowest region of the structural support;

the middle region of the structural support;

the highest region of the structural support; and within the structural support.

10. The apparatus of claim 9, wherein the water-emitting nozzle is located in any one of:

the lowest region of the structural support;

the middle region of the structural support;

the highest region of the structural support; and within the structural support.

11. The apparatus of claim 1, wherein the apparatus further comprises one or more of the following devices:

a lock for regulating opening of the apparatus;

more than one water-emitting nozzle;

more than one light-emitting device;

an automation device;

a solenoid;

a sensor;

a mixer;

a dose regulator;

a sound-emitting device;

a water heating element;

a laser light-emitting device;

a fiber optic light-emitting device;

a control module utilizing satellite radio frequencies;

a control module utilizing high frequencies;

a barometer;

a transmitter;

a receiver;

a timer;

a cistern and a water storage device.

12. The apparatus of claim 1, wherein the water-emitting device is located below or above ground and the light-emitting device is located below or above ground.

13. An apparatus for providing illumination and water, comprising:

a structural support;

at least one pipe for transferring water;

at least one pipe for conducting electricity;

a light emitting device; and a water-emitting nozzle, wherein the apparatus is powered using electric and hydraulic energy, and wherein the structural support substantially encases the light-emitting device and the water emitting nozzle, and wherein the light-emitting device substantially encases the water-emitting nozzle.

14. The apparatus of claim 13, wherein the structural support substantially encases the at least one pipe for conducting electricity and wherein the at least one pipe for conducting electricity is located to the exterior of the apparatus.

15. The apparatus of claim 13, wherein the structural support substantially encases the at least one pipe for conducting electricity and wherein the at least one pipe for conducting electricity forms one piece with the apparatus.

16. The apparatus of claim 13, wherein the at least one pipe for conducting electricity and the at least one pipe for conducting water serve to conduct the electric and hydraulic energy to the apparatus.

17. The apparatus of claim 13, wherein the water-emitting nozzle is any one of:

a spray nozzle;

a fire sprinkler; and a fumigation nozzle.

18. The apparatus of claim 13, wherein the height of the structural support is independent of the height of the water-emitting nozzle and the light-emitting device.

19. The apparatus of claim 13, wherein the light-emitting device is located in any one of:

the lowest region of the structural support;

the middle region of the structural support;

the highest region of the structural support; and within the structural support.

20. The apparatus of claim 19, wherein the water-emitting nozzle is located in any one of:

the lowest region of the structural support;

the middle region of the structural support;

the highest region of the structural support; and within the structural support.

21. The apparatus of claim 13, wherein the apparatus further comprises one or more of the following devices:

a lock for regulating opening of the apparatus;

more than one water-emitting nozzle;

more than one light-emitting device;

an automation device;

a solenoid;

a sensor;

a mixer;

a dose regulator;

a sound-emitting device;

a water heating element;

a laser light-emitting device;

a fiber optic light-emitting device;

a control module utilizing satellite radio frequencies;

a control module utilizing high frequencies;

a barometer;

a transmitter;

a receiver;

a timer;

a cistern and a water storage device.

22. The apparatus of claim 13, wherein the water-emitting device is located below or above ground and the light-emitting device is located below or above ground.

* * * * *